US011891098B1

(12) United States Patent
Smythe et al.

(10) Patent No.: US 11,891,098 B1
(45) Date of Patent: Feb. 6, 2024

(54) USE OF ARTIFICIAL INTELLIGENCE TO DETECT DEFECTS IN TRAINS AND METHOD TO USE

(71) Applicants: Dan Smythe, Jacksonville, FL (US); Jeffrey Neccial, Jacksonville, FL (US)

(72) Inventors: Dan Smythe, Jacksonville, FL (US); Jeffrey Neccial, Jacksonville, FL (US)

( * ) Notice: Subject to any disclaimer, the term of this patent is extended or adjusted under 35 U.S.C. 154(b) by 0 days.

(21) Appl. No.: 18/124,673

(22) Filed: Mar. 22, 2023

(51) Int. Cl.
*B61L 25/02* (2006.01)
*B61L 25/04* (2006.01)

(52) U.S. Cl.
CPC ..... *B61L 25/021* (2013.01); *B61L 25/04* (2013.01); *B61L 2207/02* (2013.01)

(58) Field of Classification Search
CPC ..... B61L 25/021; B61L 25/04; B61L 2207/02
USPC ..... 701/19
See application file for complete search history.

(56) References Cited

U.S. PATENT DOCUMENTS

| | | | | |
|---|---|---|---|---|
| 8,446,467 | B2 | 5/2013 | Tilton | |
| 10,296,794 | B2 | 5/2019 | Ratti | |
| 10,649,988 | B1 | 5/2020 | Gold | |
| 11,037,443 | B1 | 6/2021 | Cui | |
| 11,052,821 | B2 | 7/2021 | Pedersen | |
| 2018/0339720 | A1 * | 11/2018 | Singh | G06T 7/001 |
| 2022/0017129 | A1 * | 1/2022 | Mian | B61K 9/04 |

FOREIGN PATENT DOCUMENTS

| | | | | |
|---|---|---|---|---|
| CN | 113895482 A | * | 1/2022 | |
| KR | 102340024 B1 | * | 12/2021 | |
| WO | WO-2007091072 A1 | * | 8/2007 | B61L 25/021 |

OTHER PUBLICATIONS

CN-113895482-A (Zhang et al.) (Jan. 7, 2022) (Machine Translation) (Year: 2022).*
KR-102340024-B1 (Joon et al.) (Dec. 17, 2021) (Machine Translation) (Year: 2021).*

* cited by examiner

*Primary Examiner* — Mahmoud Gimie
(74) *Attorney, Agent, or Firm* — Lawrence J. Gibney

(57) ABSTRACT

It is imperative that the integrity of a train and its railcars be maintained. A defective part or parts on a train may cause the derailment of the train and its railcars. A derailment often causes serious personal and property damage. The use of artificial intelligence that has been applied to this system will detect possible flaws or defects in the railroad car. A portal through which the train will pass houses cameras and a means of illumination to take high resolution images of the train through the portal. This information is then stored on a software platform. It has a feature which can include a human in the loop process that verifies the accuracy of the information. The solution also transmits detected defect images and information to a remote location for analysis.

8 Claims, 1 Drawing Sheet

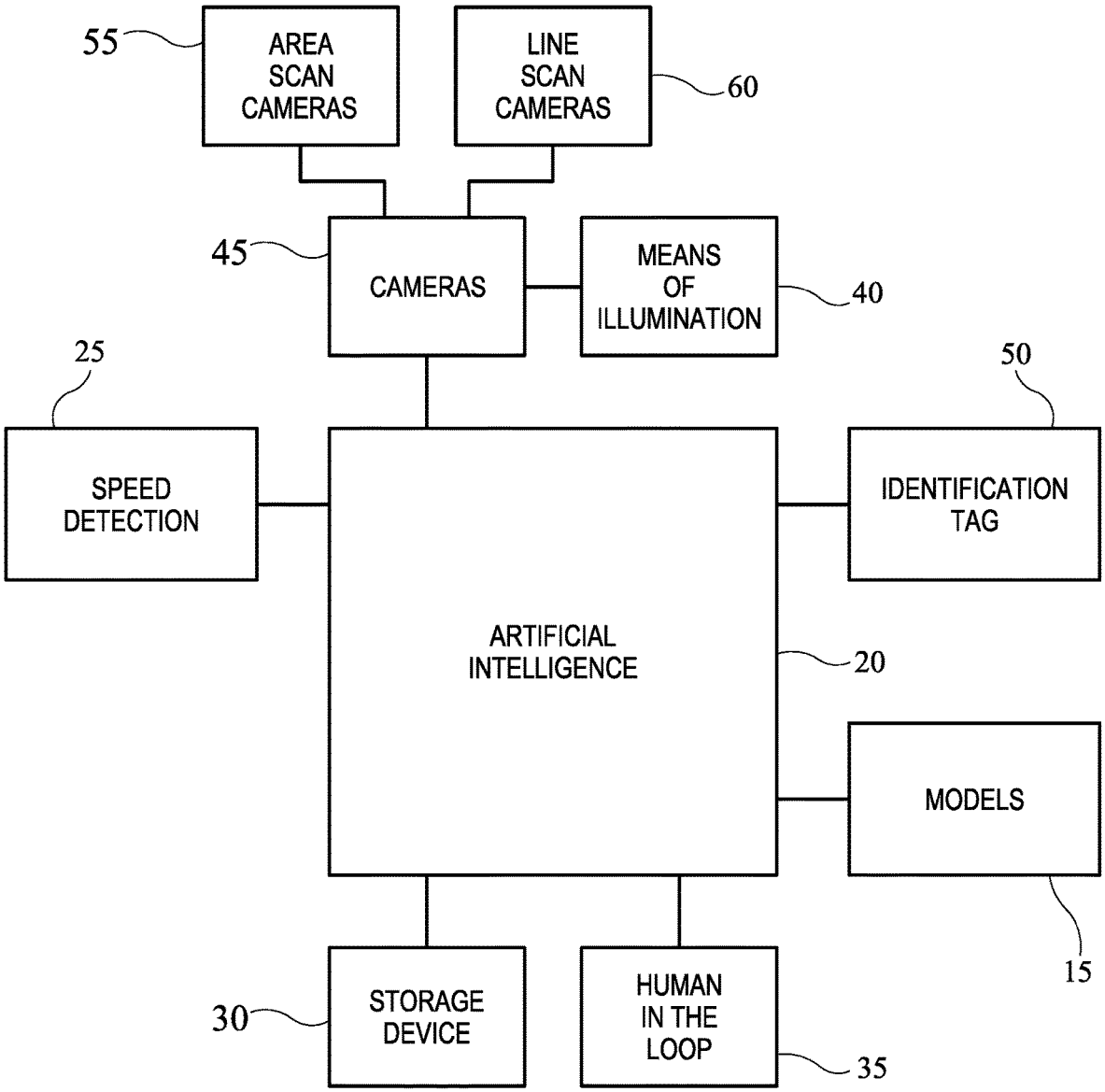
55
AREA SCAN CAMERAS
LINE SCAN CAMERAS
60
45
CAMERAS
MEANS OF ILLUMINATION
40
25
50
SPEED DETECTION
IDENTIFICATION TAG
ARTIFICIAL INTELLIGENCE
20
MODELS
15
30
STORAGE DEVICE
HUMAN IN THE LOOP
35

USE OF ARTIFICIAL INTELLIGENCE TO DETECT DEFECTS IN TRAINS AND METHOD TO USE

A. FIELD OF THE INVENTION

A train is a collection of different type of railroad cars that are joined together. It is imperative that the structural integrity of a railcar be maintained and a variety of components on railroad cars be inspected. Some of these components are clearly visible and some are less visible. The placement of all the components is critical to the proper operation of the train. In the prior art, the train would be stopped to inspect the components of the railroad cars and this reduces the productivity of the train. In the industry dwell time is a measure of the time that the train is not moving.

The challenge to reduce dwell time and still maintain the integrity of the train and its components is developing technology that enables the capture of high resolution images while the train is moving. There are a multitude of components that can be inspected on a train, including air hoses, axles, bearings, the condition of a box door, brake components, the condition of a hopper hatch or whether it is open, the condition of a knuckle pin, the condition of a truck spring to name just a few. All these components of the train must be inspected frequently and the failure of any part of a component may place the integrity of the entire train at risk.

The current application captures high resolution images while the train is moving. Any anomalies detected on the railcars that makeup the train are detected by artificial intelligence that is incorporated into the system. The use of artificial intelligence is becoming more and more common place with many different types of applications.

In this application, artificial intelligence, more specifically supervised machine learning, augments the effectiveness of mechanical railcar inspectors as they perform the inspection of railcars. Human intervention may be used to enhance the accuracy of the results and improve delivery of detection information.

B. PRIOR ART

There are many prior art references to patents and application that incorporate the use of artificial intelligence. The specific application in this case is for the railroad industry, which has its own unique environmental and logistical challenges.

Some of the relevant prior art includes the following: Tilton, U.S. Pat. No. 8,446,467, Ritti, U.S. Pat. No. 10,296,794 and Gold, U.S. Pat. No. 10,649,988.

The Tilton reference is a handheld speed detection of video and timing apparatus. In this application, the device measures the speed of a train and then uses video to capture images of the moving train. The Ritti reference is an on demand artificial intelligence patent in the roadway stewardship system, which is used to determine traffic violations. While this is not directly related to trains, it does show an application in using artificial intelligence. The Gold reference uses artificial intelligence in marine machine learning. It discusses storage systems or storage devices. In the present application, there is a method to store information.

Another reference can be found at Cui, U.S. Pat. No. 11,037,443. The Cui references a facilitation of collaborative vehicle warnings. Another reference is Petersen U.S. Pat. No. 11,052,821, which is a motor vehicle artificial intelligence expert system that is a type of dangerous driving.

Theses references highlight the uses of artificial intelligence in various applications. However, none of the prior art references discuss the use of artificial intelligence to detect railroad car anomalies; the railroad industry presents unique challenges in terms of capturing high resolution images and analyzing those images. None of the prior art references singularly or in combination claim the specific components of this system.

BRIEF SUMMARY OF THE INVENTION

Trains are comprised of many railroad cars that are joined together and move at rapid speeds in remote locations. Each train is comprised of a unique collection of railroad cars. Regardless of the exact composition of the train, the connection points between the railroad cars and other features such as chains, hoses, and pins to name a few examples. Each one of the separate components serves a function on the railcar and a failure of any one of these components may lead to disastrous results. The challenge is to capture high resolution images of a moving train and its components and analyze those images against known standards. In this application artificial intelligence is used for the analysis of the high-resolution images.

Each railcar has a unique identification tag which can be scanned. Once the tag is scanned, the system uses information from the tag to obtain pertinent details of the specific railcar. Such details include the location of specific items that should be inspected on a train car. The data derived from each railcar is stored in the system.

One of the unique challenges of railroad cars is that there are many different types of railcars. For example, there are boxcars, which transport general merchandise and tank cars that transport fluids. The boxcar and tank cars are just two examples of the many types of railroad cars. The present application will target specific components of each railcar that comprise the train, depending on the type of railcar. The system will capture high resolution images of each railcar and the components of each railcar including the connection means regardless of the type or railcar.

The present application target specific components of each railcar that comprise the train, depending on the application that is requested by the end user. The system will capture high resolution images of each railcar and the components of each railcar as the train car moves through portals that are constructed at predetermined locations.

Before the train enters the portal, the speed of the train is detected by a speed detection device. The speed detection system will activate when the system detects the presence of a train. The speed of the train will determine the acquisition rate of the cameras that will capture the high-resolution images of the moving train and its railcars. The cameras may be line scan cameras or area scan cameras. The cameras and lights are strategically placed on the portal and will be activated at times determined by the system triggering. At the predetermined time, lighting will be energized to assist in the capture of high-resolution images of the train cars.

The train travels along a set of defined tracks; portals are erected at predetermined points along the track system through which the train will pass. The portal is a large structure that surrounds the track but allows the train to pass through it. Cameras and lights are mounted on the portal structure and permit the capture of high-resolution images of the individual railcars at predetermined times.

Artificial intelligence supervised machine learning models are active in the system and are used by the system to identify defects on the rail cars based on the images taken in the portal. Multiple views (sides, top, bottom) of the railcars containing the components and the connection points between respective railcars are captured. The images are then processed by through supervised machine learning models which detect defects in those components and connection points.

To detect defects in images of railcars, it is necessary to first label many images of each type of railcar order to train the artificial intelligence machine learning. Algorithms are developed and trained using these labeled images, and the individual models are used to compare the captured images to the defective parts labeled in many similar images of similar type railcars. The parameters of various levels of business logic implemented in the inferencing scripts in the system are combined with results from the machine learning models to detect areas of concern.

To improve the precision of detections delivered in real time to clients, and enable continuous improvement of model performance through active learning of the machine learning models, a human review is also inserted into the detection process to verify the validity of the incoming detection data. In this system it is referred to as the human in the loop (HITL) feature.

New algorithms are being developed depending on the specific part or component that is being inspected on the images. Modularity is also part of the system because one size does not fit all, and this modularity will allow a customer to specifically design his/her application on the specific needs of the end use customer.

BRIEF DESCRIPTION OF THE DRAWINGS

The FIGURE is a schematic of the components of this device.

NUMBERING REFERENCE

15 Models of Railcars
20 Artificial Intelligence
25 Speed Detection Apparatus
30 Storage Device
35 Human In The Loop (HITL)
40 Illumination
45 Cameras
50 Identification Tags
55 Area Scan Cameras
60 Line Scan Cameras

DETAILED DESCRIPTION OF THE EMBODIMENTS

A train is comprised of an engine or locomotive and a plurality of railroad cars. During normal train operations, an engineer will operate the locomotive in the forward most car; this forward placement makes it extremely difficult if not impossible for the operator to view the other railroad cars that comprise the train. The operator cannot view the components of the train on the underside of the train. During normal operation the train will travel on a set of tracks from the point of origin to the point of destination at relatively high speeds in remote locations.

There are many different types of railroad cars that form a train. Each railroad car has an identification tag 50 that will store the characteristics of that specific railroad car. Some of the characteristics that may be stored include the weight of the car when empty, the connection points, the location of hoses or hopper doors, the positions of valves or latches and other components of the railroad car to name a few. This unique identifying information tag is scanned and stored in the system. Models of railcars are also stored in the system and will be used to compare with the captured images of the actual railcars on the train.

As the train travels along the tracks the speed of the train is detected by a speed detection device. The speed detection device determines the shutter speed of the cameras as the train moves through a portal. The speed detection device will activate at a predetermined point before the train enters the portal. A plurality of sensors (not depicted) on the rail determine the speed of the wheel. The speed detection device 25 calculates the speed of the train and the speed of the train determines the shutter speed of the cameras which are used to capture the images. The speed detection device is linked to the cameras and the lighting to enable the capture of the images of the train as it moves through the portal.

As the train moves along the tracks it will pass through a portal, which is a large structure on which cameras 45 and lighting 40 are mounted; cameras and lighting may also be provided on the ground below the train. The portal extends over the outside of the tracks on both sides of the tracks.

As the train passes through the portal, a plurality of cameras, 45, capture high resolution images of the surfaces of the train. The cameras may be line scan cameras 60 or area scan cameras 55 depending on the specific needs of the user. A means of illumination 40 is also provided to ensure that high resolution images are captured in all lighting conditions. The means of illumination may be comprised of LED lights or stadium lighting depending on the specific needs of the user or the environment that is encountered.

The captured images include all sides of the train including the bottom, top, and all sides of the train as well as the connection points between the individual railroad cars. These captured images are stored in the storage devices 30 that is part of this application.

The system uses artificial intelligence supervised machine learning to detect areas of concern for railcars. Models of train cars 15 are downloaded into the system. Each of the models have the specific dimensions and characteristics of the specific types of train cars. These Artificial Intelligence Model 15 images of railroad train cars are stored in the system and are used to compare to the actual captured images of a specific type of railcar. Each railcar has a unique identification tag that is scanned as the train moves through the portal; this identification tag contains the information about the specific railcar. The information that is gathered from the unique identification tag about a specific railcar may include hose placement, cotter pin placement, or bearing placement that is specific to that type of railcar. The information about the specific railcar is then compared to the stored models of train cars. Models of the types of railcar that have been stored in the system are compared to the actual captured images. For instance, if the railcar that is scanned is a hopper car, stored images of hopper cars are compared to the captured images. The system detects defects on both freight train cars as well as railcars used for passenger rail service.

As the train moves along the tracks, the speed detection system 25 will activate and calculate the speed of the train. The speed of the train is used to activate the acquisition rate of the cameras. The train will pass through the portal and the cameras will capture high-resolution images and store them into the system.

Algorithms are developed for each type of defect, and the algorithms are used to detect defects or areas of concern in the captured images. Possible areas of concern may include hose placement, cotter pin placement and brake or wheel wear and tear. Specific algorithms that are directed to specific areas of concern are used depending on the component of the railroad car to detect and analyze specific areas of concern. The system catalogs the images and then forwards them to the human in the loop (HITL) system, 35. The HITL system validates the results of the analyzed data; a human will review the images and data to determine the validity of the information that has been captured and compared to the stored images. The human in the loop system and process, when enabled, can be used to increase the precision of the information that is being provided to the railcar operator. In addition, the validated images of defects are used to increase the accuracy of the machine learning models through supervised machine learning; as more data becomes available additional algorithms are developed to better detect defects.

The stored information can be transmitted in real time to a remote location for analysis.

While the embodiments of the invention have been disclosed, certain modifications may be made by those skilled in the art to modify the invention without departing from the spirit of the invention.

The inventors claim:

1. The use of artificial intelligence to detect anomalies in moving trains, which is comprised of a portal, wherein the portal has defined sides and a defined top, wherein the portal is a structure that surrounds the tracks, wherein a train passes through the portal, a plurality of cameras, wherein the plurality of cameras is mounted to the portal and/or to the surface below the train, wherein the plurality of cameras capture high resolution images, a means of illumination, wherein the means of illumination is mounted to the portal and/or to the surface below the train, a speed detection device, wherein the speed detection device is linked to the plurality of cameras, wherein the speed detection device determines the shutter speed of the plurality of cameras, an identification tag, wherein the identification tag is attached to the railcar, wherein the identification tag contains the information about a specific railcar, a storage device, wherein the storage device houses the captured images, wherein the storage device houses information about the railcars, a plurality of models of railroad cars, wherein models of railroad cars are uploaded to the storage device, algorithms, wherein algorithms are developed to detect areas of concern, said algorithms are incorporated into the storage device, a human in the loop step, wherein a human in the loop validation is provided, wherein the human in the loop validates detection images that can be used to augment existing training sets, wherein the augmented training sets improve the machine learning models, wherein results of areas of concern can be transmitted to a remote location, wherein the results are transmitted in near real time.

2. The use of artificial intelligence to detect anomalies in moving trains as described in claim 1 wherein the plurality of cameras are line scan cameras.

3. The use of artificial intelligence to detect anomalies in moving trains as described in claim 1 wherein the plurality of cameras are area scan cameras.

4. The use of artificial intelligence to detect anomalies in moving trains as described in claim 1 wherein the means of illumination is LED lighting.

5. The use of artificial intelligence to detect anomalies in moving trains as described in claim 1 wherein the means of illumination is stadium lighting.

6. The use of artificial intelligence to detect anomalies in moving trains as described in claim 1 wherein the plurality of models depict different types of railroad cars.

7. A method to use artificial intelligence to detect anomalies in moving trains which is comprised of the following steps:

a. providing a plurality of cameras to capture high resolution images of a moving train, b. providing illumination proximate to the plurality of cameras, c. providing a means to detect the speed of the train, d. linking the speed of the train with the shutter speed of the plurality of the cameras, e. capturing detection images of the moving train, f. classifying detection images of the moving train, f. storing the detection images on a software platform, g. downloading images of model railcars on the software platform, h. comparing the captured detection images of the railcars with the stored images of model railcars on the software platform, i. analyzing the detection images by a human in the loop to the stored images in the software, k. transmitting the data to a remote location.

8. The method to use artificial intelligence to detect anomalies in moving trains as described in claim 7 which is further comprised of model retraining.

* * * * *